United States Patent [19]

Benson

[11] 4,058,968

[45] Nov. 22, 1977

[54] BULKED YARN AND METHOD OF FORMING A BULKED YARN

[75] Inventor: Gustav E. Benson, Newark, Ohio

[73] Assignee: Owens-Corning Fiberglas Corporation, Toledo, Ohio

[21] Appl. No.: 720,321

[22] Filed: Sept. 3, 1976

[51] Int. Cl.[2] ..... D02G 3/34; D02G 1/16; D02G 3/24

[52] U.S. Cl. ..... 57/140 R; 28/273; 57/157 F

[58] Field of Search ..... 57/34 B, 140 J, 140 R, 57/157 F, 90, 91; 28/72.12, 273

[56] References Cited

U.S. PATENT DOCUMENTS

| | | | |
|---|---|---|---|
| 3,113,413 | 12/1963 | Jacobs et al. | 57/34 B |
| 3,253,396 | 5/1966 | Fish | 57/34 B |
| 3,328,863 | 7/1967 | Cobb et al. | 57/34 B X |
| 3,381,346 | 5/1968 | Benson | 57/34 B X |
| 3,457,715 | 7/1969 | Eldridge et al. | 57/34 B X |
| 3,854,313 | 12/1974 | Heichlinger | 28/72.12 |

FOREIGN PATENT DOCUMENTS

| | | |
|---|---|---|
| 826,641 | 2/1960 | United Kingdom |

*Primary Examiner*—Donald Watkins
*Attorney, Agent, or Firm*—John W. Overman; Ronald C. Hudgens; Gregory Dziegielewski

[57] ABSTRACT

A method and apparatus for producing a composite bulked or texturized yarn having a generally uniformly bulked core yarn component of continuous filaments having groups of core yarn filaments extending outwardly from the core component in undulatory waves having substantially less filament density than the core component, and having a varyingly bulked effect yarn component of continuous filaments having groups of effect yarn filaments extending outwardly from the effect yarn component in undulatory waves such that the groups of effect yarn filaments form slubs at regions along the length of the composite yarn. The filaments forming the slubs return to each respective nucleus portion of the segment on each side of the slub. Selected filaments within the waves have different lengths so that the waves are comprised of filaments based at various distances from the core and are spaced from one another within the wave. The product is further characterized by the absence of closed or crunodal loops and by the undulatory shape of the waves.

22 Claims, 7 Drawing Figures

BULKED YARN AND METHOD OF FORMING A BULKED YARN

The method of producing a bulked yarn comprises advancing a core and an effect yarn to a zone of fluid turbulence and deflecting the effect yarn from its primary path over randomly varying distances at randomly varying intervals to randomly vary the speed of the effect yarn entering the zone of fluid turbulence. The composite yarn formed is collected at a speed less than the speed at which the core and effect yarns are advanced to the zone of fluid turbulence. Furthermore, the bulked strand is tensioned to permanently reduce the bulkiness of the core yarn and to permanently increase the difference in bulkiness between the slubbed and non-slubbed portions and to lock the filaments of the effect yarn among the filaments of the core yarn.

BACKGROUND OF THE INVENTION

Bulky or texturized yarns in which relatively straight and closely compacted filaments have been separated and convoluted by passing the unbulked yarn through an enclosed area of fluid turbulence are well known in the prior art. U.S. Pat. No. 2,783,609 discloses one such yarn and the apparatus for producing it. Bulky yarns of this type are characterized by the presence of large numbers of closed or crunodal loops which vary in size in accordance with the fluid pressure at the jet and the relative rates of which the yarn is fed to and withdrawn from the area of fluid turbulence or jet. Also bulky yarns having a core portion of substantially linear, closely grouped filaments and groups of dispersed filaments in successive regions along the outside surface of the core portion extending outwardly in elongated undulatory waves are well known in the prior art. U.S. Pat. No. 3,411,287 and No. 3,488,670 disclose such a yarn and the method and apparatus for producing it.

Also, composite bulked yarns having intermittent areas of increased texturization or bulkiness are well known in the art. U.S. Pat. No. 3,262,177 discloses a composite texturized yarn having primarily one degree of bulkiness over the entire length of the yarn with intermittent areas of increased texturization or bulkiness, known as slubs, intermittently located along the length of the yarn. Such a yarn is characterized by convolutions or closed loops that impart the bulkiness to the yarn. The yarn is texturized by passing the component yarns simultaneously through a zone of fluid turbulence or a jet. The slubs are induced intermittently into the yarn by increasing the speed of the feed rolls delivering at least one of the yarns to the jet or zone of fluid turbulence.

SUMMARY OF THE INVENTION

This invention pertains mainly to a composite bulked yarn having a major portion of generally uniformly bulked or texturized segments randomly interrupted by areas of increased texturization or bulkiness, known as slubs. The slubs have a randomly varying length and are distributed at randomly varying intervals along the length of the yarn. The composite texturized yarn is further characterized in that the texturization or bulkiness, including the slub portions, is comprised of filaments of both of the component yarns extending outwardly from the nucleus or core portion in elongated undulatory waves of filaments in more concentrated groupings. It is an object of this invention to produce such a yarn. It is another object of the invention to produce the slub sections such that the slubs have a randomly varying length and are located at randomly varying intervals along the length of the composite yarn.

Another object of the invention is to provide a means for controlling the overfeed of the effect yarn to produce the slubs as identified above.

It is another object of the invention to produce a composite texturized yarn wherein it is not necessary to apply a liquid binder to the composite yarn to lock in the texturization or bulkiness of the yarn so that the yarn will be suitable for further processing such as weaving.

It is another object to produce a bulked yarn having regions of one degree of bulkiness and other regions having another degree of bulkiness.

These and other objects and advantages of the invention are obtained, at least in part, by controlling the feeding rate of the effect yarn into the zone of fluid turbulence by transversely moving the effect yarn from its primary path at randomly varying intervals for randomly varying distances and tensioning the composite bulk yarn sufficiently to reduce the texturization of the core yarn to permanently increase the difference in texturization between the slub portion and the non-slub segments and to lock the filaments of the effect yarn among the filaments of the core yarn.

DETAILED DESCRIPTION OF THE INVENTION

The novel bulky or texturized yarn made by the apparatus and method of this invention can be made from an untextured yarn strand of continuous filaments of any origin. Glass fibers are particularly adapted for use in forming the bulky product of this invention. It is to be understood that the term "yarn" as used herein refers to a bundle of filaments, twisted or untwisted, and the filaments prior to being treated are generally parallel and are densely compacted in a yarn having a uniform average diameter.

Figure 1:
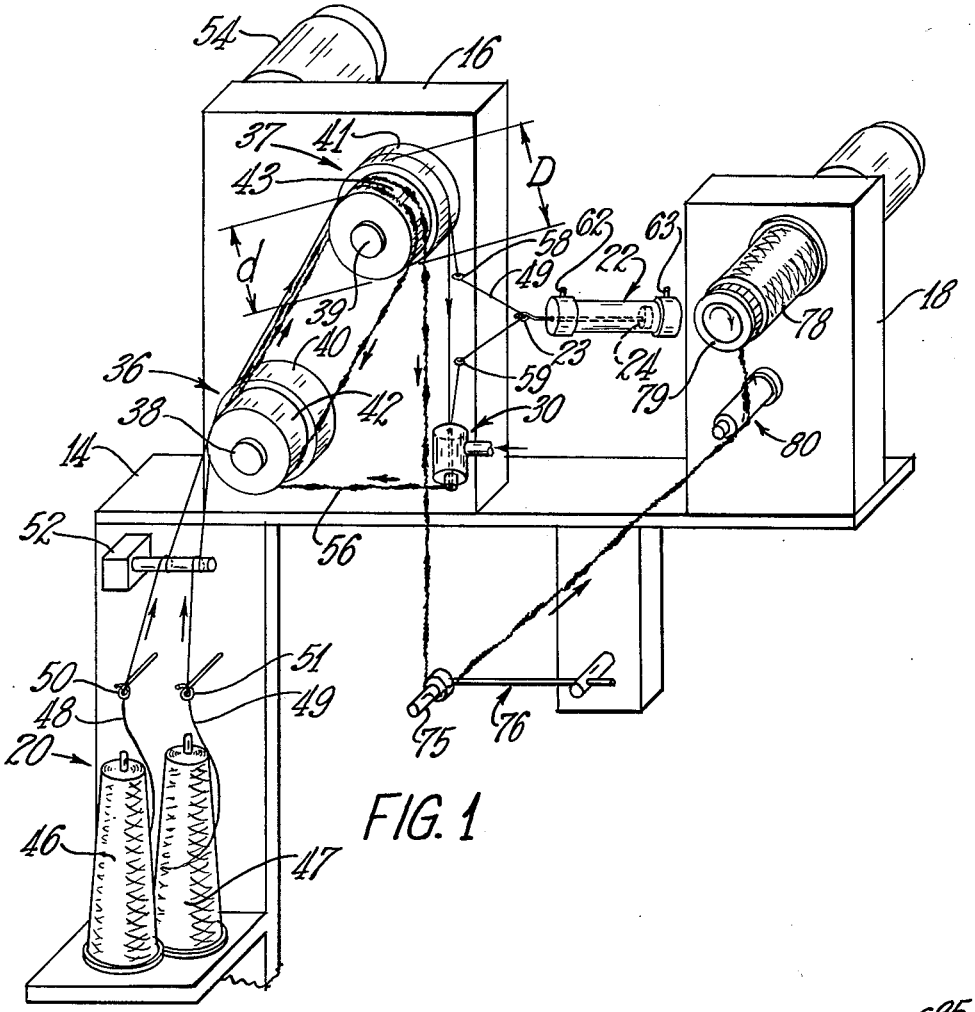
FIG. 1 is a schematic view in perspective of the complete yarn bulking apparatus of this invention.

Referring to FIG. 1, a horizontal platform 14 supports a vertically extending housing 16 and a winder mechanism 18. A yarn supply station 20 extends below platform 14.

A pneumatic cylinder 22 and fluid jet 30 are fixed relative to housing 16. The construction and operation of such fluid jets are well known in the art, and the fluid jet may be of the type disclosed in U.S. Pat. Nos. 3,402,446 and 3,381,346. A pair of double diameter, coaxial yarn feed and take-up rollers 36 and 37 are secured to rotatable shafts 38 and 39, respectively. Shafts 38 and 39 are journaled for rotation on parallel axes in housing 16 by suitable bearings (not shown). The arrangement of feed and take-up rollers, fluid jet, and winder mechanism is well known in the art. U.S. Pat. Nos. 3,488,670 and 3,411,287 describe apparatus similar to that shown in FIGS. 1, 4 and 5 and are hereby incorporated herein. A modified version of such methods and apparatus is preferred since such basic methods and apparatus enable yarn to be texturized in speeds in excess of 3,000 feet per minute.

Rollers 36 and 37 can be rotated clockwise at the same speed, and assuming that each of the rollers 36 and 37 have identical dimensions, the surface or peripheral speeds of rollers 36 and 37 are the same for corresponding points thereon.

Each of the rollers 36 and 37 have first cylindrical sections 40 and 41, respectively, having a diameter "D" and second coaxially secured cylindrical sections 42 and 43, respectively, having a diameter "*d*" which is smaller than diameter "D". As is well known, when the first cylindrical sections 40 and 41 are used to feed a yarn or yarns to jet 30 and the second cylindrical sections 42 and 43 are used to withdraw the texturized or bulked yarn from jet 30 the yarn or yarns will be advanced toward the jet 30 at the same first velocity and the texturized or bulked yarn will be withdrawn from the jet 30 at a second velocity, which is less than the first velocity. Such a difference in velocities produces a predetermined amount of "overfeed"; that is, because the first cylindrical sections 40 and 41 are coaxial with second cylindrical sections 42 and 43, respectively, and are turned at the same angular speed, the peripheral speed of sections 40 and 41, due to the larger diameter, will cause the yarn to be initially advanced to the jet 30 at a linear velocity in excess of the linear velocity at which the bulked yarn is withdrawn from the jet 30 by sections 42 and 43, thus producing a predetermined amount of initial overfeed of the yarn or yarns advancing undisturbed toward jet 30. The amount of initial overfeed is determined by the ratio of diameters, $D/d$, assuming the yarn or yarns are advancing undisturbed to the jet 30.

It is well known in the art, that a yarn or yarns being fed into a zone of constant fluid turbulence at a constant rate of overfeed produce a texturized or bulked yarn of a generally uniform average degree of bulkiness over the length of the bulked yarn. That is, the bulked yarn is characterized by an absence of "slubs" or regions of substantially increased bulkiness.

However, according to the principles of this invention a bulked yarn having slubs of randomly varying length located at randomly varying intervals may be produced by accumulating at least a portion of the initial "overfeed" and then releasing at least a portion of that accumulated portion to produce a varying final overfeed. The varying final overfeed is of randomly varying amounts at randomly varying intervals.

As shown in FIG. 1, an untexturized core yarn 48 and an untexturized effect yarn 49 are drawn from supply packages 46 and 47 respectively, through guide eyes 50 and 51 respectively, to a tensioning unit 52. The tensioning unit 52 and guide eyes 50 and 51 are fixed to platform 14.

The core yarn 48 and effect yarn 49 are directed around and between the outer surfaces of cylindrical sections 40 and 41 a number of times sufficient to provide enough engagement with these surfaces to prevent slippage when the rollers are driven at high speed. The rollers can be driven by motor 54 in a similar manner as set forth in U.S. Pat. No. 3,488,670.

The core yarn 48 advances directly, relatively undisturbed, from the surface of cylindrical section 41 to fluid jet 30 at a constant predetermined first velocity. The core yarn 48 has a constant predetermined amount of overfeed since the combination texturized or bulked yarn 56 is withdrawn from jet 30 at constant predetermined second velocity different from the first velocity. The combination yarn 56 is directed around and between the outer surfaces of cylindrical sections 42 and 43 a number of times sufficient to provide enough engagement with these surfaces to prevent slippage when the rollers are driven at high speed.

As the core yarn 48 advances from the surface of cylindrical section 41 the effect yarn 49 advances therefrom at the same first velocity. However, the effect yarn 49 passes through an intermittent accumulation or deflection zone before entering jet 30. In such zone the effect yarn 49 is acted upon to alter the velocity of the effect yarn entering the jet 30 such that the effect yarn 49 advances to jet 30 at randomly varying velocities for randomly varying periods thereby randomly varying the final overfeed of the effect yarn.

Figure 2:
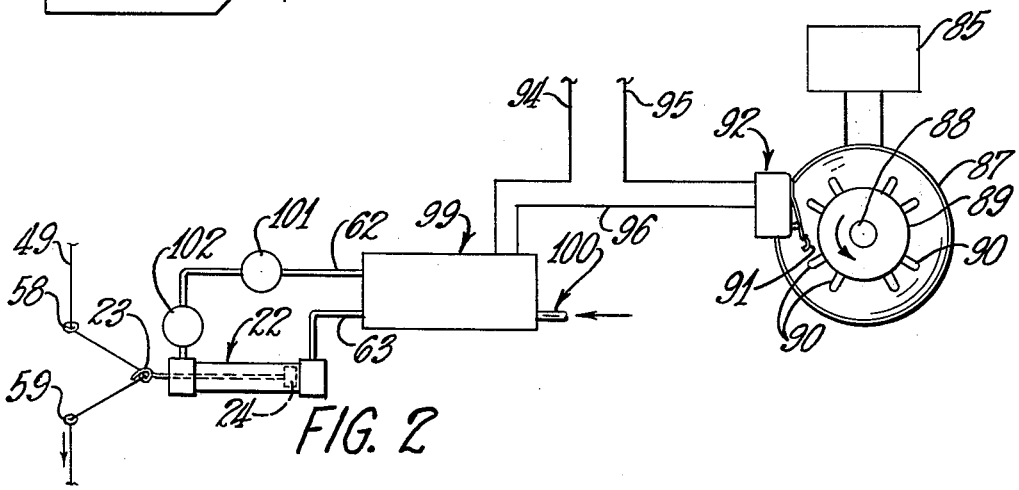
FIG. 2 is a schematic view of the effect yarn being deflected or accumulated before entering the texturizing jet and of a means for cycling or controlling the air cylinder and guide eye for deflecting or accumulating the effect yarn.
Figure 3:
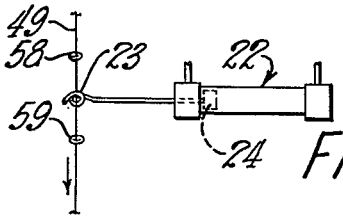
FIG. 3 is a schematic view showing the effect yarn in an undeflected state.

As shown in FIGS. 1, 2 and 3, effect yarn 49 advances through guide eyes 58 and 59, which are fixed relative to housing 16. Guide eye 23 is fixed to and reciprocates with piston 24 of air cylinder 22, which is a dual acting type of air cylinder. With the piston 24 at an extreme end of its stroke, the guide eye 23 allows the effect yarn 49 to assume a straight or primary path between guide eyes 58 and 59. Of course, air cylinder 22 could be located to provide a primary path for the effect yarn at some other point along the stroke of the piston 24. The operation of such air cylinders is well known in the art. Briefly however, as compressed air is alternately supplied to and released from opposite ends of the bore of the air cylinder by lines or hoses 62 and 63 the piston 24 moves along the axial bore thereof, moving guide eye 23 with it. The means for controlling the displacement of the piston 24 and guide eye 23 so as to move the piston 24 over randomly varying intervals, will be explained in detail later in this description.

The velocity at which guide eye 23 moves transversely to the undeflected or primary path of the effect yarn also controls the final velocity at which the effect yarn enters the jet 30. As guide eye 23 moves transversely away from the undeflected path, it causes the effect yarn 49 to take a longer and longer path, which, so long as the guide keeps moving away, causes the effect yarn 49 to have a final velocity entering the jet 30 less than the constant predetermined velocity of the effect yarn entering the accumulation zone. If the guide eye 23 stops, the final velocity of the effect yarn will be equal to the constant predetermined velocity of the effect yarn entering the zone. Conversely, if guide eye 23 is moving toward the undeflected or primary path the final velocity of the effect yarn entering the jet 30 will be greater than the constant predetermined velocity of the effect yarn entering the accumulation zone. The final velocity being a function of constant predetermined velocity and deflection velocity at which guide eye 23 transversely deflects the effect yarn 49. Thus, the final "overfeed" of the effect yarn is increased and decreased.

Preferably, the effect yarn should not be transversely moved or deflected at a velocity or rate which would cause the final velocity of the effect yarn 49 entering jet 30 to be less than velocity of the combination yarn otherwise being withdrawn from the jet. Therefore, at any time the difference between the constant predetermined velocity of the effect yarn entering the accumulation zone and the final velocity of the effect yarn leaving the accumulation zone or entering the jet 30 should be less than, or equal to, the rate of initial "overfeed" or the difference between the linear velocity of effect yarn 49 leaving cylindrical surface 41 and the predetermined constant linear velocity of the combination yarn 56 being withdrawn from the jet 30.

The rate at which guide eye 23 transversely moves the effect yarn 49 toward its undeflected path determines the degree of bulkiness of the slub. Generally, the faster the rate of return the larger the cross sectional dimensions of the composite yarn at the slub, assuming that the jet can assimilate all of the increase in overfeed.

The relationship or orientation between the feed and take-up rollers, the texturizing jet, and the yarns should be effected as set forth in U.S. Pat. No. 3,488,670 to enable the high speed operation of this system. Even with the addition of the accumulation zone, the effect yarn should be oriented to enter the jet angled from the axis thereof as set forth in U.S. Pat. No. 3,488,670.

After being withdrawn from jet 30 at right angles immediately upon exit therefrom and passing around cylindrical surfaces 42 and 43, the combination yarn 56 is advanced downwardly to a yarn guide or roller 75 which is rotatably secured to the free end of a pivoted tension arm 76 which is a part of the constant tension winder mechanism 18. Even though the portions of the path of the bulked yarn may appear to intersect in FIG. 1, they do not.

Constant tension winders such as those commercially available from a number of manufacturers include a tension sensing mechanism, such as tension arm 76, which, through electrical or electrical-mechanical controls will vary the winding speed of the yarn package on its mandrel in accordance with variations in the tension of the yarn being wound. The composite texturized yarn, after being led around roller 75, is taken directly to a composite texturized or bulked yarn package 78, wound on mandrel 79 of the constant tension winder which includes a traverse mechanism 80.

A suitable sizing material, generally a liquid, can be applied by suitable equipment known in the art (not shown) to the composite yarn to lock the filaments of the core and effect yarns in their relation to one another. Suitable liquid sizing can be starch, hot melt or solvent type coatings commercially available.

However, in the preferred embodiment of this invention such a sizing is not applied to the composite yarn. A tensile load or tension is applied to the combination yarn sufficient to permanently reduce the texturization or bulkiness of the core yarn component to increase the difference in degree of bulkiness between the slubs and the non-slub segments of the combination yarn and to lock the filaments of the effect yarn component between the filaments of the core yarn component to decrease the tendency of the core and yarns to separate. Of course, the tension upon the composite yarn should be insufficient to completely remove the bulkiness from the core or effect yarn components.

When the composite yarn is so tensioned, the filaments of the core yarn component are permanently moved or drawn back toward their unbulked state thereby mechanically holding the remaining waves in place. With respect to the degree of bulkiness, the filaments of the effect yarn component remain relatively unchanged as compared to the filaments of the core yarn after the composite yarn is tensioned.

Generally, it is possible to adjust or modify the winder mechanism 18 to apply a load to suitably tension the combination yarn as set forth above. The method by which the amount of tension can be increased or decreased using such commercially available winders is well known in the art.

EXAMPLE

Figure 6:
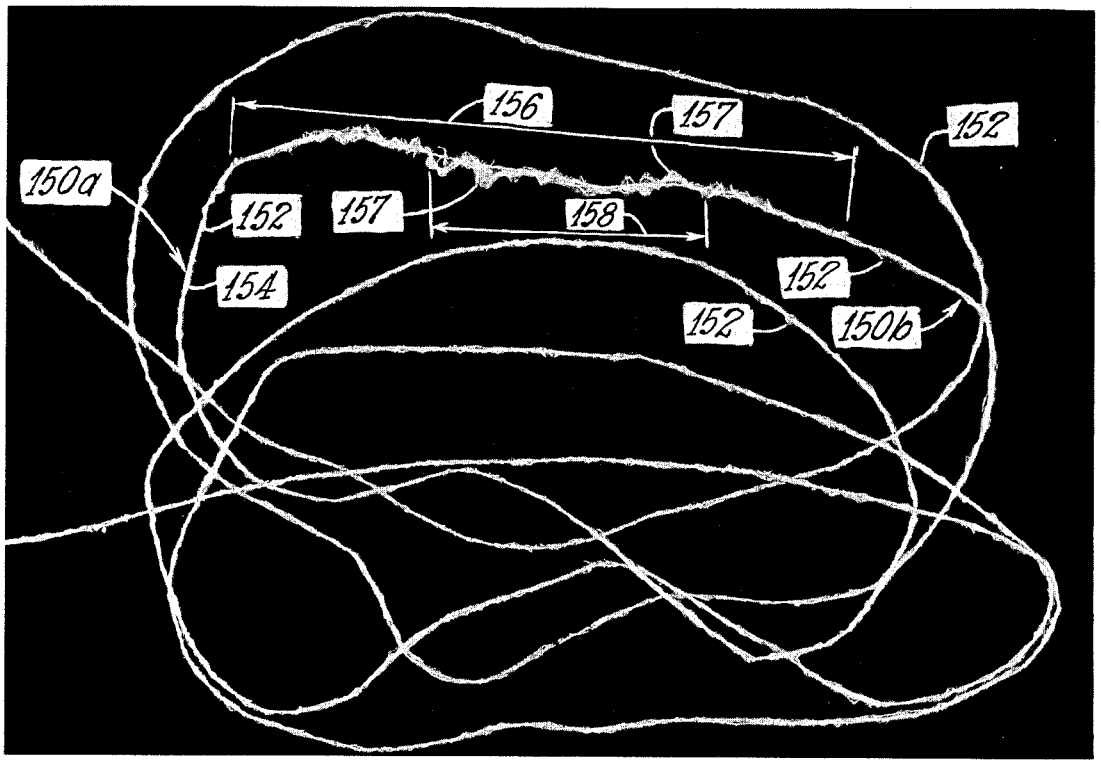
FIG. 6, on an enlarged scale, is a view of a section of the novel yarn product produced by the apparatus and method of this invention illustrating the undulatory wave like configurations of the slub and non-slub sections of the yarn.
Figure 7:
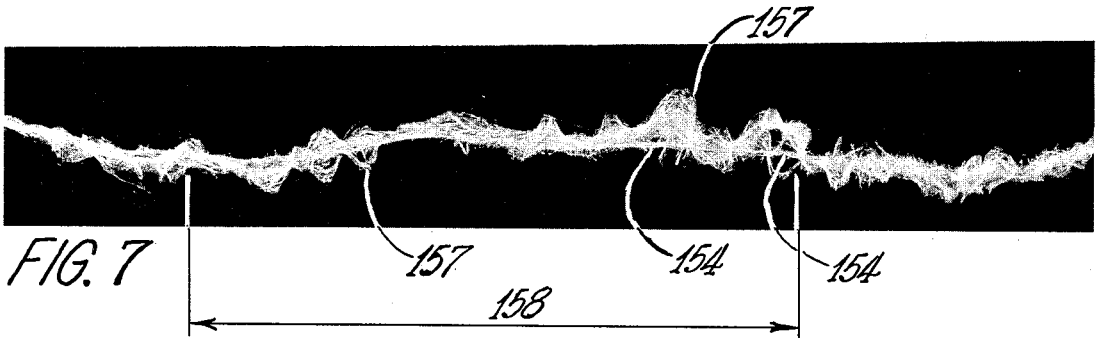
FIG. 7 is a view of the slub section of the yarn shown in FIG. 6 on an enlarged scale.

A combination bulked yarn of glass filaments similar to that shown in FIGS. 6 and 7, was produced using apparatus similar to that in FIGS. 1 and 2 according to the principles of the invention, and using a core yarn of glass filaments (a DE100) and an effect yarn of glass filaments (a DE37). The linear velocity of the combination yarn leaving the jet was between 1,200 and 1,800 feet per minute. Although, speeds in excess of 3,000 feet per minute are believed possible. The pressure of the air delivered to the jet (approximately 75 psig) was within the normal range for such jets and yarns used in systems similar to those described in U.S. Pat. No. 3,488,670, and the rate of initial "overfeed" was approximately 10%. However, systems having rates of initial overfeed within the range of 5–20% are believed to be suitable. The constant tensile load on the combination yarn between roller 75 and traverse mechanism 80 was measured to be within the range of 90 grams to 115 grams. A constant tensile load within the range of 80g to 125g can be employed to produce a suitable combination yarn. The amount of the load is a factor in the characteristics of the final product. No sizing was applied to the combination yarn as it was being wound on the winder. Using the deflection or accumulation system similar to that in FIG. 2, a combination bulked yarn having slubbed sections of randomly varying length at randomly varying intervals along the length the otherwise generally, uniformly bulked yarn was produced. It appeared that such system ran for hours without producing a repeating pattern of slubs.

As shown in FIG. 2, a commercially available controller 85, such as a "Statohm" Model No. 6225.103-38 available from the Electric Regulator Corp. of Norwalk, Conn., compatible with electric motor 87 cooperates therewith to continuously vary the speed of the ouput shaft 88 of motor 87. A bump wheel 89 is securely fastened to shaft 88 and rotates therewith. The irregularly spaced fingers 90 of wheel 88 intermittently contact arm 91 of a suitable limit switch 92 to produce an intermittent pulse-like electrical signal having a randomly varying period of duration at randomly varying intervals. Leads 94 and 95 are connected to a suitable source of direct current with lead 96 completing the electrical path between limit switch 92 and solenoid operated air valve 99.

There are also a number of other systems for producing such pulse-like signals capable of operating such a valve. For example, the systems for producing such signals as set forth in U.S. Pat. Nos. 2,612,743 and 2,976,105 can be adapted to produce pulse-like electrical signals having a randomly varying length or period of duration occurring at randomly varying intervals to control valve 99. Also "Ladder Program Processors" available from the "Square D Company" may be adapted to generate such signals for extended periods of time before repeating.

Solenoid operated fluid or air valve 99 can be one of the number of commercially available types. Valve 99 is connected with a source of fluid or air pressure (not shown) by main supply line 100. The pulse-like electrical signals cause pressurized air to be alternately fed to and released from lines 62 and 63. Lines 62 and 63 connect valve 99 with air cylinder 22, with line 63 supplying air pressure to cylinder 22 causing guide eye 23 to move effect yarn 49 back toward its primary path thereby increasing the rate of "overfeed" to the jet 30. Line 62 supplies air pressure to cylinder 22 causing guide eye 23 to move effect yarn 49 away from its primary path thereby decreasing the rate of "overfeed" to jet 30.

In the preferred embodiment, the accumulation or deflection system is adapted to move the effect yarn away from its primary path at a rate substantially less than the rate at which it is returned. To effect this, line 62 has a commercially available flow control metering valve 101 which can be adjusted to substantially reduce the rate at which the air is delivered to the appropriate section of cylinder 22. Thus guide eye 23 and effect yarn 49 can be moved away from its primary path at a controlled rate. To allow the effect yarn to be returned at a quicker rate than at which it is deflected, a commercially available quick-release check or poppet valve 102 is employed in line 62 between cylinder 22 and metering valve 101; otherwise, the air would have to pass through the metering valve 101 to be exhausted from that portion of cylinder 22 by way of valve 99.

It requires a first period of time for piston 24 to be moved along the bore of cylinder 22 to ultimately move effect yarn 49 away from its primary path before piston 24 reaches the end of its stroke. And since such pulse-like electric signals may cause the air pressure to change from one side of the piston to the other before it reaches the end of its stroke, the distance the guide eye 23 moves the effect yarn from its primary path will randomly vary according to the duration of and intervals between the pulse-like signals. Of course, such signals could cause the guide eye 23 to reverse direction and withdraw before having fully returned to full extension or the position at which the effect yarn is allowed to assume its primary path. That is, piston 24 may not move over the full length of its stroke or travel. The effect yarn is deflected or accumulated and released for randomly varying periods at randomly varying intervals to produce the novel yarn according to the principles of this invention.

Figure 4:
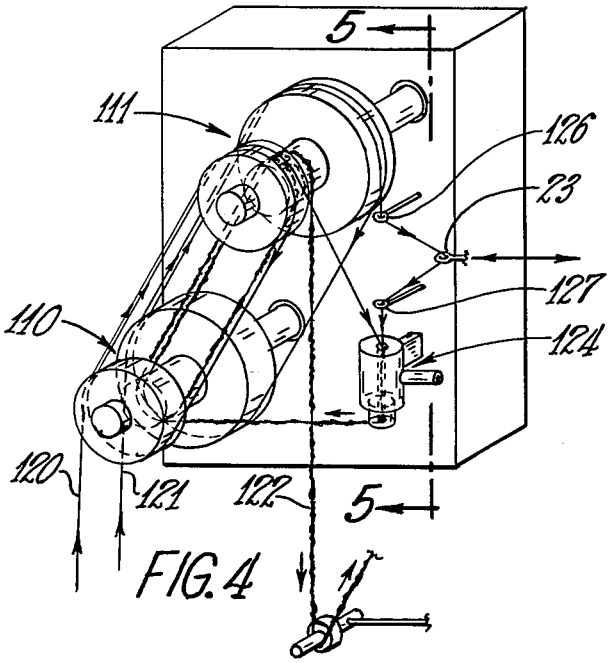
FIG. 4 is a schematic view in perspective, similar to a portion of FIG. 1, showing another embodiment of the invention wherein the core and effect yarn are initially advanced at unlike predetermined constant velocities.
Figure 5:
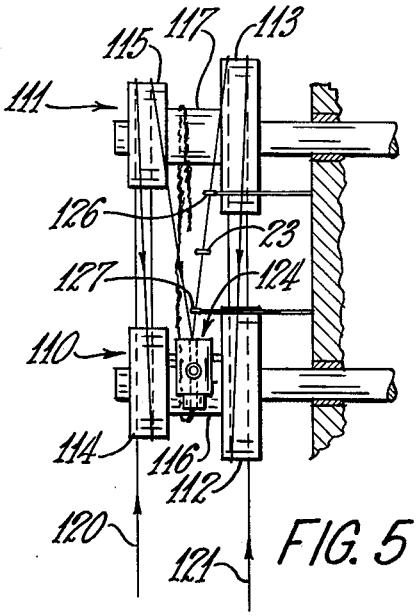
FIG. 5 is a cross sectional view taken along section line 5—5 of FIG. 4 showing in detail the alignment of various components in the embodiment of FIG. 4.

FIGS. 4 and 5 show an alternate embodiment of this invention wherein the core yarn and effect yarn are advanced at different amounts of initial "overfeed".

Each of the feed and take-up rollers 110 and 111 include three coaxial cylindrical sections 112, 114, 116, and 113, 115, 117 respectively. Cylindrical sections 112 and 113, having the greatest diameter, can be used to feed the effect yarn 121 to the accumulation zone at a first predetermined constant velocity. Cylindrical sections 114 and 115 can be used to feed or advance the core yarn 120 to the jet 124 at a second predetermined constant velocity. Cylindrical sections 116 and 117 are used to withdraw the combination bulked yarn from the jet 125 at a third predetermined constant velocity. Thus, the core yarn has an amount of "overfeed" different from the amount of initial "overfeed" of the effect yarn.

Similarly, the effect yarn 121, passes through an intermittent deflection or accumulation zone before entering jet 124. Also, movable guide 23 moves along a path transverse to the undeflected path the effect yarn would follow between fixed guide eyes 126 and 127. The system for moving guide eye 23 can be essentially the same as that shown in FIGS. 1, 2 and 3. Also, the jet should be positioned essentially as set forth in U.S. Pat. No. 3,488,670 with respect to the feed and take-up cylindrical surfaces. Even with the apparatus of the accumulation zone, the path of yarn delivery at the jet should follow the parameters set out therein for optimization for high speed operation.

The combination bulked or texturized yarn of continuous filaments is characterized by segments having a generally uniform first degree of texturization and slubs having a second, greater, degree of bulkiness. The slubs are located at randomly varying intervals along the length of the combination yarn and have randomly varying lengths, and the filaments of the core and effect yarn components are interengaged to form a unitary combination bulked yarn.

Referring to FIG. 6, the segments of a generally uniform first degree of bulkiness **150*a* and 150*b* are characterized by randomly spaced groups of filaments extending outwardly from the core portion or nucleus of the combination yarn in undulatory waves 152 having substantially less filament density than the segment nucleus. The nucleus 154 at the segments is comprised of continuous filaments tightly grouped together in a substantially parallel relationship, and each of the waves 152** have generally equal forward and reverse slopes within each wave. Also, the waves of the segments extend radially outward from the nucleus in all directions by a substantially equal amount thereby producing a generally uniform first degree of bulkiness or texturization. Each of the waves of each segment is comprised of a group of continuous filaments taken from the nucleus on either side of the wave. And the group of filaments forming the wave appear to lie on the opposite side of the nucleus from which the wave emerges so that the waves are bound in place by the filaments of the core section at that region. Within each wave of a segment, as well as a slub, the individual filaments are of varying length so that a wave is comprised of an array of a number of filaments which are spaced apart from the outermost filament inwardly toward the nucleus.

Also, the amplitude of each of the waves of the segments can be substantially greater in depth than the diameter of the nucleus. The amplitude of a wave is the radial distance from the crest of a wave to the centerline of the nucleus thereof. Generally, adjacent waves are not formed of the same selected filaments but are composed of a different group of filaments coming out of the nucleus, and the nucleus of the segments generally appear to be formed of filaments from the core yarn component and effect yarn component. From the above description, and as can be seen in FIG. 6, the generally uniformly bulked segments of the combination yarn are similar to bulked yarn described in U.S. Pat. Nos. 3,411,287 and 3,488,670.

The slub portion 156 of the combination bulked yarn is characterized by randomly spaced surface portions having selected groups of filaments extending outwardly from the nucleus 154 of the slub portion in undulating waves 157 having less filament density than the nucleus of the slub portion. The amplitude of some of the waves 157, or even a majority of the exterior waves at approximately the midregion 158 of the slub is substantially greater than the amplitude of the waves 152 of the generally uniformly bulked segments 150*a* and 150*b* of the combination yarn. The waves 157 of the slub generally appear to gradually increase in size from approximately the same amplitude as the surface waves 152 of the segments adjoining it on one side to an amplitude substantially greater than that of the segments and then gradually decrease to approximately the same average amplitude of the surface waves 152 of the segment on the opposite side of the slub. The region 158 of the slub waves having a substantially increased amplitude appears to extend over a mid-region of the slub for approximately $\frac{1}{3}$ to $\frac{2}{3}$ the total length of the slub 156.

The substantially larger undulatory waves or wave-like arches 157 of the slub region 156 generally appear to be primarily or substantially entirely composed of filaments of the effect yarn component. The core yarn component appears to maintain the same degree of texturization for the full length of the composite yarn. That is, the average amplitude and frequency of the undulatory waves from the core yarn component are relatively uniform in the segments as well as slubs. The amplitude of some or a majority of the plurality of the exterior undulatory waves of the mid-region of the slub appears to be at least equal to, or greater than, the width or total transverse dimension of the generally uniformly bulked segments or non-slub sections. And referring to FIG. 7, the nucleus of the slub sections appears to be formed primarily of the filaments of the core yarn component which are tightly grouped together in substantially parallel relationship to form such nucleus.

The slub portions or regions, as well as the generally uniformly texturized segments or regions in the preferred embodiment, are further characterized by the absence of crunodal or closed loops formed by the filaments.

It is apparent that, within the scope of the invention, modifications and different arrangements can be made other than as herein disclosed. The present disclosure is merely illustrative with the invention comprehending all variations thereof.

I claim:

1. A bulked yarn comprising:

a continuous nucleus portion of tightly grouped and substantially parallel continuous filaments, and a surface portion having slub regions and generally uniformly bulked regions along the length of the yarn, the uniformly bulked regions having selected groups of said nucleus filaments which extend outwardly from said nucleus in undulatory waves having less filament density than the nucleus, the slub regions having selected groups of said nucleus filaments which extend outwardly from said nucleus in undulatory waves having less filaments density than the nucleus, the amplitude of the exterior waves of the slub regions being substantially larger than the amplitude of the exterior waves of the uniformly bulked region.

2. The bulked yarn of claim 1 wherein the slub regions are located at randomly varying intervals along the length of the yarn and have randomly varying lengths.

3. The bulked yarn of claim 1 where in the amplitude of the exterior waves of the slub regions is at least equal to the width of the yarn at the uniformly bulked regions.

4. The bulked yarn of claim 3 wherein there is an absence of crunodal loops.

5. A composite bulked yarn comprising:

a core yarn component of continuous filaments; and an effect yarn component of continuous filaments, the core yarn and effect yarn being interengaged to form the composite yarn having a continuous nucleus portion of tightly grouped and substantially parallel continuous filaments and a surface portion having generally uniformly bulked regions and slub regions, the generally uniformly bulked regions having groups of core yarn filaments extending outwardly from the nucleus in undulatory waves having less filament density than the nucleus, the slub regions having groups of effect yarn filaments extending outwardly from the nucleus in undulatory waves having less filament density than the nucleus, the amplitude of the outermost waves of the slub region being substantially larger than the amplitude of the outermost waves of the uniformly bulked region.

6. The composite bulked yarn of claim 5 wherein groups of effect yarn filaments extend outwardly from the nucleus in undulatory waves having less filament density than the nucleus at the uniformly bulked regions, the nucleus at any uniformly bulked region having tightly grouped and substantially parallel core yarn and effect yarn filaments therein.

7. The bulked yarn of claim 5 wherein substantially all of the tightly grouped and substantially parallel filaments of the nucleus at the mid-portion of any slub region are core yarn filaments and wherein substantially all of the filaments of the outermost undulatory waves at the mid-portion of any slub region are effect yarn filaments and wherein the core yarn having substantially the same degree of bulkiness the full length of the composite yarn.

8. The bulked yarn of claim 5 wherein the amplitude of the outermost undulatory waves at the mid-portion of any slub region is generally at least equal to the width of the composite yarn at the uniformly bulked regions.

9. The composite bulked yarn of claim 8 which is further characterized by the absence of crunodal loops.

10. The composite bulked yarn of claim 5 wherein the slub regions are located at randomly varying intervals along the length of composite yarn and have randomly varying lengths.

11. The composite bulked yarn of claim 10 wherein the amplitude of the outermost undulatory waves at the mid-portion of any slub region thereon is generally at least equal to the width of the composite yarn at any of the uniformly bulked regions.

12. The composite bulked yarn of claim 11 further characterized by the absence of crunodal loops.

13. The composite bulked yarn of claim 12 further characterized by randomly occurring voids in the slub region of the composite yarn.

14. The method of producing a bulked yarn comprising:

intermittently and alternately reducing and increasing the speed of a plurality of yarns leaving a first zone;

feeding the plurality of yarns into a second zone of fluid turbulence to form a bulked strand having primary regions having a first degree of bulkiness and secondary regions having a second degree of bulkiness; and tensioning the bulked strand to form the bulked yarn, the tension being sufficient to permanently decrease the degree of bulkiness of the primary and secondary regions.

15. The method of claim 14 wherein the speed of some of the yarns is reduced and increased at randomly varying intervals for randomly varying periods of duration.

16. The method of claim 14 wherein the tension is sufficient to lock in the filaments of the yarns among each other.

17. A method of producing a bulked yarn comprising:

advancing a core yarn and an effect yarn to a first zone at substantially the same first speed;

intermittently varying the speed of the effect yarn leaving the first zone;

feeding the core yarn and the effect yarn having the varying speed into a zone of fluid turbulence and withdrawing the bulked yarn from the zone of fluid turbulence at a second speed less than the first speed to form the bulked yarn having segments having a first degree of bulkiness and slubbed portions having a greater degree of bulkiness than the segments; and tensioning the bulked yarn sufficiently to reduce the texturization of the core yarn to permanently increase the difference in bulkiness between the segments and the slubbed portions.

18. The method of claim 17 wherein the speed of the effect yarn is varied at randomly varying intervals for randomly varying periods.

19. The method of claim 17 wherein the core yarn and effect yarn are advanced to a first zone at a constant predetermined first speed and wherein the bulked yarn is withdrawn from the zone of fluid turbulence at a constant predetermined second speed.

20. The method of producing a bulked yarn comprising:

advancing a core yarn at a constant predetermined first velocity;

advancing an effect yarn along a primary path at a constant predetermined second velocity, the first and second velocity being substantially equal;

deflecting the effect yarn from the primary path at randomly varying intervals for randomly varying distances; and, then feeding the core yarn effect yarn into a zone of fluid turbulence to form the bulked yarn and withdrawing the bulked yarn from the zone of fluid turbulence at a third velocity less than the second velocity.

21. The method of producing a bulked yarn comprising:

advancing a core yarn at a constant predetermined first velocity;

advancing an effect yarn along a primary path at a constant predetermined second velocity;

deflecting the effect yarn from the primary path at randomly varying intervals for randomly varying distances; and then feeding the core yarn and effect yarn into a zone of fluid turbulence to form the bulked yarn and withdrawing the bulked yarn from the zone of fluid turbulence at a third velocity less than the second velocity wherein the first velocity is less than the second velocity but greater than the third velocity.

22. The method of producing a bulked yarn comprising:

advancing a core yarn at a constant predetermined first velocity;

advancing an effect yarn along a primary path at a constant predetermined second velocity;

deflecting the effect yarn from the primary path at randomly varying intervals for randomly varying distances;

continuously supplying pulse-like electrical signals having a randomly varying period of duration at randomly varying intervals and controlling said deflecting in response to such signals; and then feeding the core yarn and effect yarn into a zone of fluid turbulence to form the bulked yarn and withdrawing the bulked yarn from the zone of fluid turbulence at a third velocity less than the second velocity.

* * * * *